US011406879B2

(12) United States Patent
Kitazaki et al.

(10) Patent No.: US 11,406,879 B2
(45) Date of Patent: Aug. 9, 2022

(54) GOLF CLUB

(71) Applicant: PRGR Co., Ltd., Tokyo (JP)

(72) Inventors: Tsuyoshi Kitazaki, Tokyo (JP); Masayoshi Kogawa, Tokyo (JP); Yoh Nishizawa, Tokyo (JP); Norihiko Nakahara, Tokyo (JP)

( * ) Notice: Subject to any disclaimer, the term of this patent is extended or adjusted under 35 U.S.C. 154(b) by 905 days.

(21) Appl. No.: 15/998,828

(22) PCT Filed: Feb. 7, 2017

(86) PCT No.: PCT/JP2017/004389
§ 371 (c)(1),
(2) Date: Aug. 15, 2018

(87) PCT Pub. No.: WO2017/141769
PCT Pub. Date: Aug. 24, 2017

(65) Prior Publication Data

US 2021/0205669 A1 Jul. 8, 2021

(30) Foreign Application Priority Data

Feb. 15, 2016 (JP) ..... JP2016-025683

(51) Int. Cl.
*A63B 53/02* (2015.01)
*A63B 53/12* (2015.01)
*A63B 53/04* (2015.01)

(52) U.S. Cl.
CPC ..... *A63B 53/02* (2013.01); *A63B 53/12* (2013.01); *A63B 53/0466* (2013.01); *A63B 2209/02* (2013.01)

(58) Field of Classification Search
CPC ..... A63B 53/02; A63B 53/12; A63B 2209/02; A63B 53/0466
See application file for complete search history.

(56) References Cited

U.S. PATENT DOCUMENTS 1,792,852 A * 2/1931 Mattern ..... A63B 53/12 473/312
5,226,652 A * 7/1993 Sato ..... A63B 53/02 473/312

(Continued)

FOREIGN PATENT DOCUMENTS

JP S51-045463 4/1976
JP S53-154077 12/1978

(Continued)

OTHER PUBLICATIONS

International Search Report for International Application No. PCT/JP2017/004389 dated Mar. 7, 2017, 4 pages, Japan.

*Primary Examiner* — Sebastiano Passaniti
(74) *Attorney, Agent, or Firm* — Thorpe North & Western

(57) ABSTRACT

A golf club includes a reinforcing member installed on an inner circumferential surface of a shaft near a tip-side end portion and extends in an axial direction of the shaft to straddle an upper end of a cylindrical portion. The reinforcing member has a cylindrical shape configured by laminating prepregs obtained by impregnating carbon fibers being reinforcing fibers with a matrix resin. The reinforcing member is provided with: a first bias layer located at the innermost side in a radial direction; a second bias layer laminated on an outer side of the first bias layer (16A) in the radial direction, an orientation direction of the reinforcing fibers having an opposite direction to the first bias layer; and a straight layer laminated on the outer side of the second bias layer in the radial direction, an orientation direction of the reinforcing fibers being parallel to the axial direction of the shaft.

9 Claims, 4 Drawing Sheets

(56) References Cited

U.S. PATENT DOCUMENTS

| | | | | |
|---|---|---|---|---|
| 5,720,671 | A * | 2/1998 | Cheng | A63B 53/02 473/305 |
| 5,885,169 | A * | 3/1999 | Ishizuka | A63B 53/10 473/305 |
| 7,874,934 | B2 * | 1/2011 | Soracco | A63B 60/42 473/307 |
| 7,878,921 | B2 * | 2/2011 | Bennett | A63B 53/047 473/307 |
| 8,491,411 | B2 * | 7/2013 | DeShiell | A63B 53/10 473/320 |
| 9,387,369 | B2 * | 7/2016 | Yamamoto | A63B 53/12 |
| 2003/0073508 | A1 * | 4/2003 | Kumamoto | A63B 60/54 473/319 |
| 2005/0233824 | A1 | 10/2005 | Kumamoto | |
| 2007/0026960 | A1 * | 2/2007 | Butler | A63B 60/00 473/316 |
| 2009/0005189 | A1 * | 1/2009 | Hodgetts | A63B 60/16 473/289 |
| 2013/0017902 | A1 * | 1/2013 | Cheng | A63B 60/00 473/319 |
| 2013/0172097 | A1 | 7/2013 | Yashiki | |
| 2014/0357398 | A1 * | 12/2014 | Yamamoto | A63B 53/12 473/305 |
| 2020/0001144 | A1 * | 1/2020 | Becktor | A63B 60/54 |

FOREIGN PATENT DOCUMENTS

| | | |
|---|---|---|
| JP | 2003-117034 | 4/2003 |
| JP | 2004-160057 | 6/2004 |
| JP | 2011-147543 | 8/2011 |
| JP | 2013-138753 | 7/2013 |
| JP | 2014-233303 | 12/2014 |

* cited by examiner

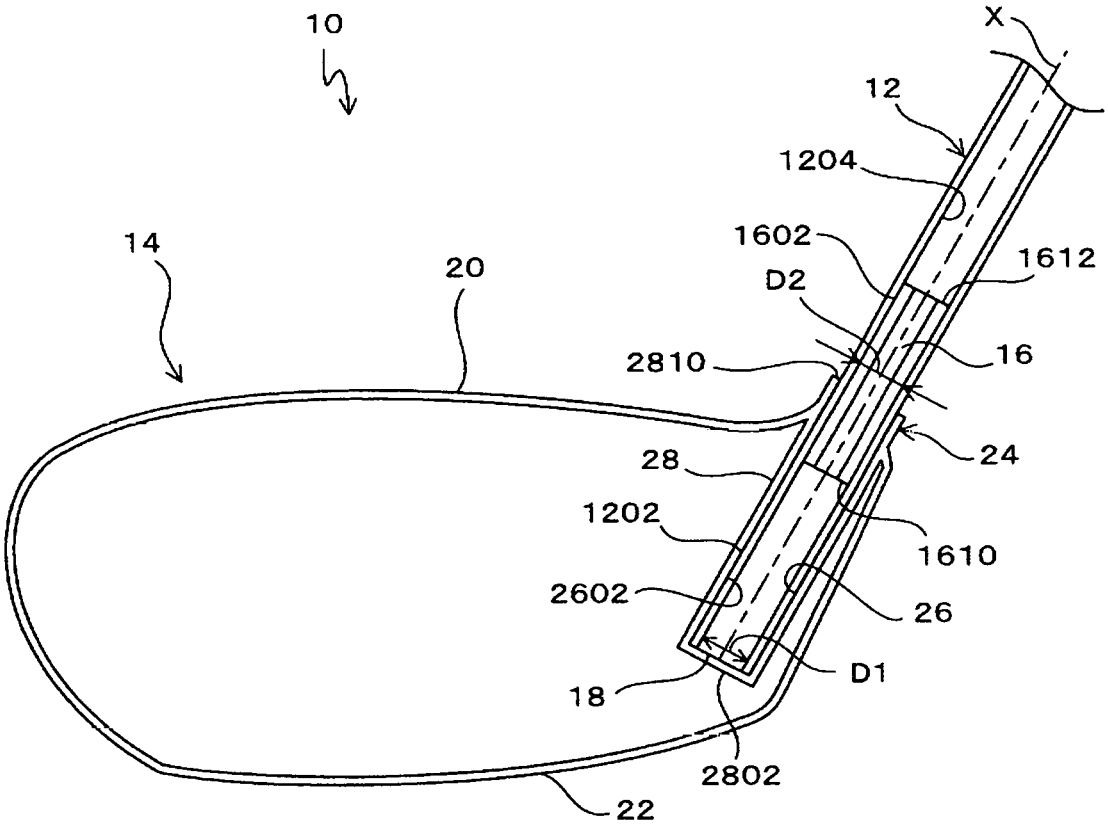
FIG. 1
FIG. 2A
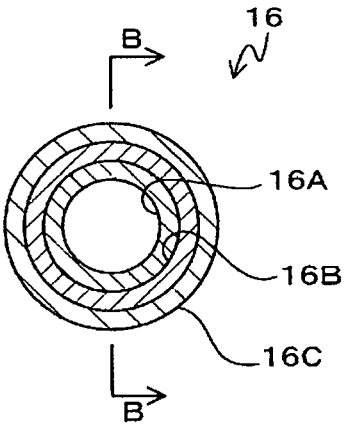
FIG. 2B
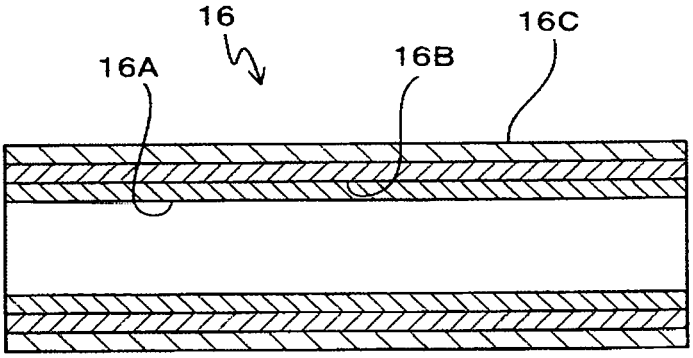

| | EXPERIMENT EXAMPLE 1 | EXPERIMENT EXAMPLE 2 | EXPERIMENT EXAMPLE 3 | EXPERIMENT EXAMPLE 4 | EXPERIMENT EXAMPLE 5 | EXPERIMENT EXAMPLE 6 | EXPERIMENT EXAMPLE 7 | EXPERIMENT EXAMPLE 8 | EXPERIMENT EXAMPLE 9 | EXPERIMENT EXAMPLE 10 |
|---|---|---|---|---|---|---|---|---|---|---|
| REINFORCING MEMBER? | NO | YES | YES | YES | YES | YES | YES | YES | YES | YES |
| DIFFERENCE ΔD BETWEEN TIP SIDE END PORTION INNER DIAMETER D1 AND REINFORCING MEMBER OUTER DIAMETER D2 (mm) ΔD = D1 - D2 | - | 0.1 | 0.1 | 0.1 | 0.1 | 0.1 | 0.3 | 0.5 | 0.7 | 0.1 |
| DISTANCE H1 FROM UPPER END OF CYLINDRICAL PORTION TO LOWER END OF REINFORCING MEMBER (mm) | - | 30 | 3 | 5 | 10 | 15 | 15 | 15 | 15 | 27 |
| DISTANCE H2 FROM UPPER END OF CYLINDRICAL PORTION TO UPPER END OF REINFORCING MEMBER (mm) | - | 0 | 27 | 25 | 20 | 15 | 15 | 15 | 15 | 3 |
| IMPACT LOAD (IZOD IMPACT STRENGTH) | 100 | 101 | 105 | 115 | 133 | 135 | 121 | 117 | 107 | 104 |
| DURABILITY | 100 | 102 | 103 | 110 | 127 | 125 | 122 | 113 | 105 | 103 |
| TOTAL | 200 | 203 | 208 | 225 | 260 | 260 | 243 | 230 | 212 | 207 |

FIG. 4

GOLF CLUB

TECHNICAL FIELD

The present technology relates to a golf club.

BACKGROUND ART

Golf clubs are provided that include a hollow shaft, and a golf club head having a hosel portion into which a tip side end portion of the shaft is inserted and fixed.

The hosel portion projects to the inside and outside of the golf club head, and has a cylindrical portion provided with a shaft installation hole into which the tip side end portion is inserted.

In such a golf club, every time a ball is struck, a large impact load is applied to the portion of the shaft corresponding to the upper end of the cylindrical portion, so a portion of the shaft can become damaged.

Therefore, in Japanese Unexamined Patent Publication No. 2014-233303, technology for reinforcing the shaft while minimizing the increase in mass is disclosed in which a solid reinforcing rod is installed on the inner circumferential surface of the tip side end portion of the shaft extending in the axial direction of the shaft so as to straddle the upper end of the cylindrical portion.

However, in the art described above, a synthetic resin molded product is used as the material of the solid reinforcing rod, so there is scope for improvement in terms of increasing the strength of the shaft.

Also, the load applied to the shaft in the torsional direction when hitting a ball has not particularly been taken into consideration.

SUMMARY

With the foregoing situation in view, the present technology provides a golf club that is advantageous in terms of reducing the torsion of the shaft when hitting a ball and increasing the durability of the shaft, while minimizing the increase in mass of the golf club.

The present technology provides a golf club that includes: a hollow shaft; and a golf club head having a hosel portion into which a tip side end portion of the shaft is inserted and fixed. The hosel portion includes a cylindrical portion that projects to the inside and outside of the golf club head and in which a shaft installation hole is provided for inserting the tip side end portion. A reinforcing member is installed on an inner circumferential surface of the shaft extending in an axial direction of the shaft so as to straddle an upper end of the cylindrical portion. The reinforcing member has a cylindrical shape configured by laminating prepegs in which reinforcing fiber is impregnated with matrix resin. Also, the reinforcing member is configured from a first bias layer in which an orientation direction of the reinforcing fiber intersects with the axial direction of the shaft, a second bias layer in which an orientation direction of the reinforcing fiber intersects with the axial direction of the shaft and intersects with the orientation direction of the reinforcing fiber of the first bias layer, and a straight layer in which the orientation angle of the reinforcing fiber is parallel to the axial direction of the shaft.

According to the present technology, torsion of the shaft is reduced when hitting a ball mainly by the bias layers, and the strength with respect to impact loads applied to the portion of the shaft corresponding to the upper end of the hosel portion and the durability of the shaft are increased by the straight layer in addition to the bias layers, while minimizing the increase in mass of the reinforcing member (golf club).

BRIEF DESCRIPTION OF DRAWINGS

FIG. 1 is a cross-sectional view of a golf club according to an embodiment.

FIG. 2A is a cross-sectional view of the reinforcing member sectioned in a plane orthogonal to the center axis thereof, and FIG. 2B is a cross-sectional view at the line BB in FIG. 2A.

FIG. 4 is a table showing evaluation results of Experiment Examples 1 to 10.

DETAILED DESCRIPTION

Figure 3A:
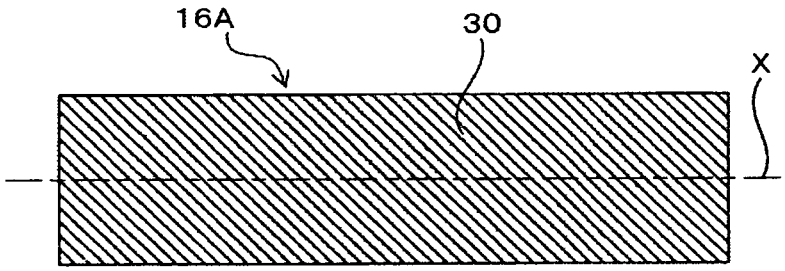
FIG. 3A is a plan view of a prepreg that forms a first bias layer located on the innermost layer of the reinforcing member.

An embodiment of the present technology will be described.

As illustrated in FIG. 1, a golf club 10 includes a shaft 12, a golf club head 14, and a reinforcing member 16.

The shaft 12 is hollow, and at a first end in a longitudinal direction is a tip side end portion 18 on which the golf club head 14 is installed, and on a second end in the longitudinal direction is a bat side end portion that is not illustrated on the drawings and on which is installed a grip.

In the present embodiment, the shaft 12 is made from steel.

Note that various known materials in the related art such as carbon fiber reinforced plastic or the like using carbon fibers as reinforcing fibers can be used as the material of the shaft 12.

The golf club head 14 in the present embodiment is a hollow wooden golf club head such as a driver or a fairway head or the like, and includes a face portion that is not illustrated on the drawings and that has height and that extends laterally, a crown portion 20 that configures the upper portion of the golf club head 14 and that extends to the rear from the upper portion of the face portion, a sole portion 22 that configures the lower portion of the golf club head and that connects the lower portion of the face portion and the lower portion of the crown portion 20, and a hosel portion 24.

Note that the golf club head 14 may also be a solid or hollow iron or a utility.

The hosel portion 24 is provided on a heel side of the golf club head 14, and is the position where the tip side end portion 18 of the shaft 12 is inserted and fixed.

The hosel portion 24 projects to the inside and outside of the golf club head 14, and includes a cylindrical portion 28 provided with a shaft installation hole 26 into which the tip side end portion 18 is inserted.

In the present embodiment, the shaft 12 is fixed to the hosel portion 24 with adhesive that is filled in the space between an outer circumferential surface 1202 of the shaft 12 and an inner circumferential surface 2602 of the shaft installation hole 26.

Note that various known attachment structures in the related art such as screwing a bolt into a female screw provided on the tip side end portion 18 of the shaft through a bolt through hole formed in a floor surface 2802 of the cylindrical portion 28, or the like, can be used for fixing the shaft 12 to the hosel portion 24.

The reinforcing member 16 is installed on an inner circumferential surface 1204 of the shaft 12 near the tip side end portion 18, and extends in the axial direction of the shaft 12 so as to straddle an upper end 2810 of the cylindrical portion 28.

The reinforcing member 16 is installed on the shaft 12 using adhesive filled in the space between an outer circumferential surface 1602 of the reinforcing member 16 and the inner circumferential surface 1204 of the shaft 12.

The reinforcing member 16 is configured from fiber reinforced plastic configured from prepregs in which reinforcing fibers are impregnated with matrix resin. The reinforcing member 16 has a cylindrical shape with a uniform inner diameter and outer diameter.

Various types of known reinforcing fibers in the related art can be used as the reinforcing fiber, but in the present technology, the reinforcing fiber is preferably carbon fiber.

The matrix resin is, for example, an epoxy resin, an unsaturated polyester resin, or the like, of which epoxy resin is preferable.

In the present embodiment, the reinforcing member 16 is configured from carbon fiber reinforced plastic (CFRP) using carbon fiber as the reinforcing fiber and epoxy resin as the matrix resin.

In the present embodiment, a unidirectional prepreg with reinforcing fiber arranged unidirectionally in the longitudinal direction is used as the prepreg.

As illustrated in FIGS. 2A and 2B, in the present embodiment, the reinforcing member 16 is configured from three layers: a first bias layer 16A located on an innermost side in a radial direction, a second bias layer 16B laminated on the outside in the radial direction of the first bias layer 16A, and a straight layer 16C laminated on the outside in the radial direction of the second bias layer 16B.

As illustrated in FIG. 3A, the first bias layer 16A is configured so that the orientation direction of reinforcing fiber 30 intersects with an axial X-direction of the shaft 12.

Figure 3B:
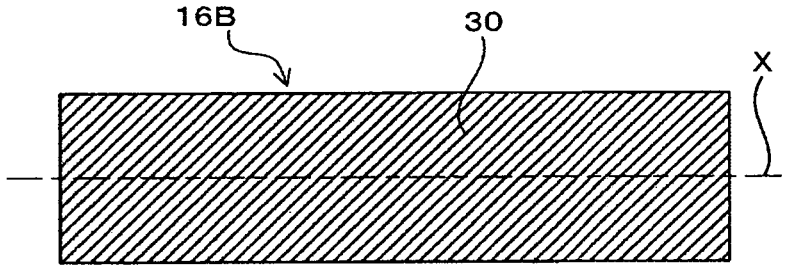
FIG. 3B is a plan view of a prepreg that forms a second bias layer that is laminated on the outside of the innermost layer of the reinforcing member.
Figure 3C:
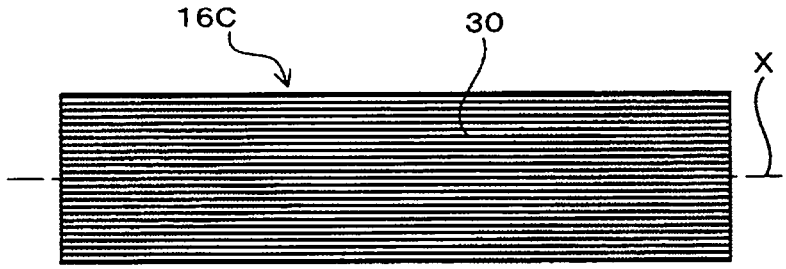
FIG. 3C is a plan view of a prepreg that forms a straight layer located on the outermost layer of the reinforcing member.

As illustrated in FIG. 3B, the second bias layer 16B is configured so that the orientation direction of the reinforcing fiber 30 has the opposite orientation direction to the reinforcing fiber 30 of the first bias layer 16A, the orientation direction of the reinforcing fiber 30 intersects with the axial X-direction of the shaft 12, and also intersects with the orientation direction of the reinforcing fiber 30 of the first bias layer 16A.

In the present embodiment, the orientation angle of the reinforcing fiber 30 of the first bias layer 16A is +45° with respect to the axial X-direction of the shaft 12, and the orientation angle of the reinforcing fiber 30 of the second bias layer 16B is −45° with respect to the axial X-direction of the shaft 12.

Therefore, the first bias layer 16A and the second bias layer 16B are configured as bias layers laminated so that the orientation direction of the reinforcing fiber 30 intersects with the axial X-direction of the shaft 12, and the orientation directions of their reinforcing fiber 30 intersect with each other.

The orientation angle of the reinforcing fiber 30 of the straight layer 16C is parallel to the axial X-direction of the shaft 12, in other words, the orientation angle of the reinforcing fiber 30 of the straight layer 16C is 0° with respect to the axial X-direction of the shaft 12.

Note that the orientation angle of the first bias layer 16A and the second bias layer 16B may be within a range that enables the bending strength of the shaft 12 to be increased while reducing the torsion of the shaft 12 by the first bias layer 16A and the second bias layer 16B as described later, and the orientation angle of the first bias layer 16A and the second bias layer 16B may be within a range of absolute value of the orientation angle greater than 0° and less than 90°.

However, the absolute value of the orientation angle is more preferably a value close to 45°, from the point of view of increasing the bending strength while reducing torsion of the shaft 12.

Note that setting the orientation angle of the first bias layer 16A and the second bias layer 16B symmetrically with respect to the axial X-direction of the shaft 12 has the advantage that the bending strength is uniform and there is no bias in the bending strength regardless of the direction of bending forces acting on the shaft 12.

Also, in the present embodiment, the straight layer 16C is arranged on the outer side in the radial direction of the first bias layer 16A and the second bias layer 16B. However, conversely, the straight layer 16C may be arranged on the inner side in the radial direction of the first bias layer 16A and the second bias layer 16B, or, the straight layer 16C may be arranged between the first bias layer 16A and the second bias layer 16B.

As illustrated in FIG. 1, in a case where the inner diameter of the tip side end portion 18 of the shaft 12 is D1, and the outer diameter of the reinforcing member 16 is D2, then the outer diameter D2 of the reinforcing member 16 is smaller than the inner diameter D1 of the tip side end portion 18 in the range from 0.1 mm to 0.5 mm.

In other words, when ΔD is the difference D1−D2, 0.1 mm≤ΔD≤0.5 mm.

When the difference ΔD is within the above range, the gap between the outer circumferential surface 1602 of the reinforcing member 16 and the inner circumferential surface 1204 of the shaft 12 is small, so this has the advantage that the reinforcing member 16 can be securely installed on the shaft 12, and strength with respect to impact loads and durability of the shaft 12 can be ensured.

When the difference ΔD is smaller than the above range, the workability of inserting the reinforcing member 16 on to the inner circumference of the shaft 12 from the tip side end portion 18 of the shaft 12 is reduced.

When the difference ΔD is larger than the above range, the gap between the outer circumferential surface 1602 of the reinforcing member 16 and the inner circumferential surface 1204 of the shaft 12 is large, so the effect of securely installing the reinforcing member 16 onto the shaft 12 is reduced, and the effect of ensuring strength with respect to impact loads and durability of the shaft 12 is reduced.

Also, a lower end 1610 of the reinforcing member 16 is located within a range from 5 mm to 30 mm from the upper end 2810 of the cylindrical portion 28 along the extension direction of the shaft 12. An upper end 1612 of the reinforcing member 16 is located within a range from 5 mm to 30 mm from the upper end 2810 of the cylindrical portion 28 along the extension direction of the shaft 12.

When the positions of the lower end 1610 and the upper end 1612 of the reinforcing member 16 are within the above range, there is the advantage that the reinforcing member 16 can be securely installed on the shaft 12, and strength with respect to impact loads and durability of the shaft 12 can be ensured.

When the positions of the lower end 1610 and the upper end 1612 of the reinforcing member 16 are below the above range, the effect that the reinforcing member 16 can be securely installed on the shaft 12 is reduced, and the effect of ensuring the strength with respect to impact loads and durability of the shaft 12 is reduced.

When the positions of the lower end 1610 and the upper end 1612 of the reinforcing member 16 are above the above range, the mass of the reinforcing member 16 increases, which affects the mass balance of the golf club 10.

Also, when bonding the shaft 12 and the cylindrical portion 28, in a case where there is no path for the air between the shaft 12 and the cylindrical portion 28 to escape, the shaft 12 is pressed away from the cylindrical portion 28 by the air, so bonding is not possible.

Thus, providing a path for escape of the air by making the inner diameter of the reinforcing member 16 from 2 mm to 6 mm is desirable in order to stabilize the operation of bonding the shaft 12 and the cylindrical portion 28, and to ensure strength with respect to impact loads.

Also, making the mass of the reinforcing member 16 1.5 g or less is advantageous in terms of minimizing the effect on the mass balance of the golf club 10.

According to the golf club 10 of the present embodiment, the reinforcing member 16 is installed on the inner circumferential surface 1204 of the shaft 12 extending along the axial X-direction of the shaft 12 so as to straddle the upper end 2810 of the cylindrical portion 28. In addition, the reinforcing member 16 is configured from the first bias layer 16A and the second bias layer 16B laminated so that the orientation direction of their reinforcing fiber 30 intersects with the axial X-direction of the shaft 12 and the orientation directions of their reinforcing fiber 30 intersects with each other, and one straight layer 16C in which the orientation angle of the reinforcing fiber 30 is parallel to the axial X-direction of the shaft 12.

The orientation direction of the reinforcing fiber 30 of the first bias layer 16A and the second bias layer 16B intersects with the axial X-direction of the shaft 12, so in addition to the effect of increasing the bending stiffness of the shaft 12, there is the effect of reducing the torsion of the shaft 12 when hitting a ball.

Also, the orientation angle of the reinforcing fiber 30 of the straight layer 16C is parallel to the axial X-direction of the shaft 12, which has the effect of mainly increasing the bending stiffness of the shaft 12.

In contrast, when the reinforcing member 16 is configured from the bias layers only, although it is possible to reduce the torsion of the shaft 12 when hitting a ball, in order to increase the bending stiffness of the shaft 12 it is necessary to provide more bias layers, which is disadvantageous in terms of reducing the weight of the reinforcing member 16. Also, there are concerns that the reinforcing member 16 will be increased in size and it would become difficult to arrange the reinforcing member 16 within the shaft 12.

Also, when the reinforcing member 16 is configured from the straight layer 16C only, although it is possible to increase the bending stiffness of the shaft 12 while reducing the increase in mass of the reinforcing member 16, it is disadvantageous in terms of reducing the torsion of the shaft 12 when hitting a ball.

Therefore, according to the present embodiment, by configuring the reinforcing member 16 from the bias layers 16A, 16B and the straight layer 16C, there is the advantage of reducing the torsion of the shaft 12 when hitting a ball while reducing the increase in mass of the reinforcing member 16 (golf club 10), and increasing the strength with respect to impact loads applied to the portion of the shaft 12 corresponding to the upper end of the hosel portion 24 and the durability of the shaft 12.

Also, the present technology can be applied to the golf club 10 with the shaft 12 made from steel or fiber reinforced plastics. However, in a case where the shaft 12 is made from steel, plastic deformation occurs more easily in the portion of the shaft 12 corresponding to the upper end 2810 of the cylindrical portion 28 of the hosel portion 24 and it becomes more fragile due to impact loads applied when hitting a ball, compared with when the shaft 12 is made from fiber reinforced plastic.

Therefore, according to the present embodiment, by using the reinforcing member 16, it is possible to strengthen the portion of a steel shaft 12 that easily becomes fragile, and this has the advantage that the strength against impact loads applied to that portion of the shaft 12 and the durability of the shaft 12 are increased.

Note that in the present embodiment, a configuration in which the straight layer is configured from a single layer and the bias layers are configured from two layers was described, but there may be two or more straight layers, and the number of bias layers may be a multiple of two.

Next, experiment examples of the present technology will be described.

FIG. 4 shows test results on the golf club 10 according to the present technology.

Test specimens of golf club 10, prepared for each test example to evaluate items that are described later, were measured to obtain indexes (evaluation points), and the two indexes were combined to obtain the total evaluation points.

(1) Impact Load (Izod Impact Test)

A 60 mm length of the shaft 12 provided with the reinforcing member 16 was cut from the tip side end portion 18 to provide Izod impact test samples.

Figure 5:
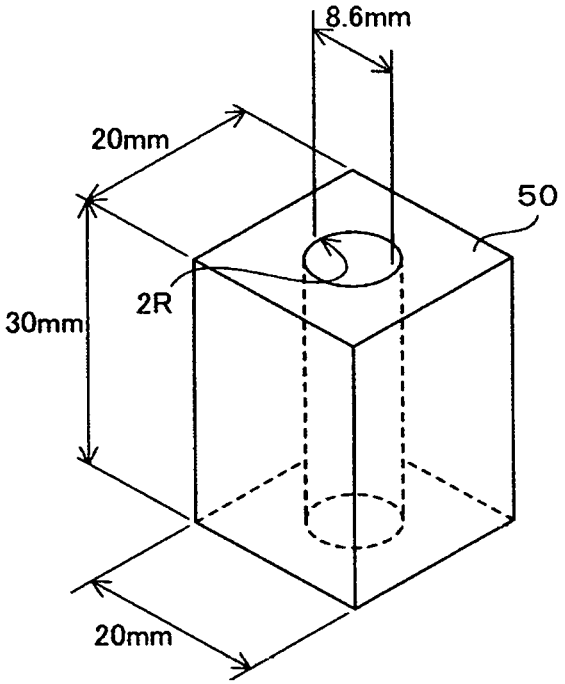
FIG. 5 is an explanatory diagram of a fixture used in the Izod impact test.
Figure 6:
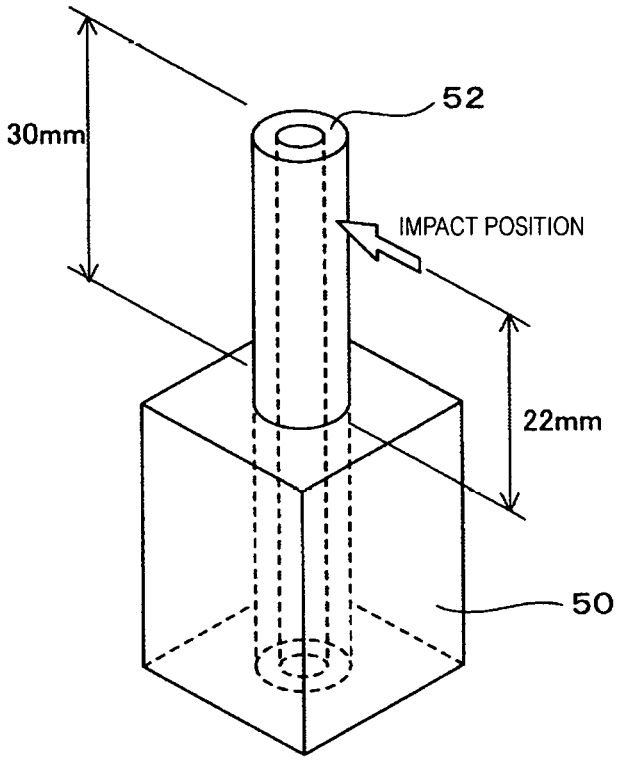
FIG. 6 is an explanatory diagram of the Izod impact test.

Izod impact tests were carried out in accordance with JIS (Japanese Industrial Standard) K 7110, by fixing a fixture 50 in an Izod impact testing machine as illustrated in FIG. 5, inserting an Izod impact test sample 52 into the fixture 50 by 30 mm as illustrated in FIG. 6, and measuring the maximum impact force applied by a hammer at a position 22 mm from the upper surface of the fixture 50. Note that a 2R chamfer was provided in advance on the top portion (impact side) of the fixture 50, and adhesive was not provided in the gap between the Izod impact test sample 52 and the fixture 50. Also, a notch was not provided on the Izod impact test sample 52.

Experiment Example 1 was taken to be an index of 100, and the higher the index, the greater the strength with respect to impact loads, and the better the evaluation.

(2) Durability

The face surface of the golf club head 14 with the shaft 12 in a fixed state was repeatedly impacted with golf balls using an air cannon, the number of strikes necessary to cause bending damage to the shaft 12 was measured, and the number of strikes was converted into an index. The ball speed was 50 m/s. The striking position was the center of the face surface 14A.

In this case, the measurement result of the golf club head 14 for Experiment Example 1 was taken to be an index of 100. Larger index values indicate better evaluation.

(3) Total Points

The total number of points was obtained by adding the two indexes for the impact load and the durability.

The total number of points for Experiment Example 1 was 200, and larger index values indicate better evaluation.

Next, Experiment Examples 1 to 10 will be described while referencing FIG. 4.

Note that in each of the experiment examples, the shaft 12 was made of steel, and the inner diameter D1 of the tip side end portion 18 of the shaft 12 was 8 mm.

Also, the reinforcing member 16 was configured the same as the embodiment, with the length of the reinforcing member 16 being 30 mm.

In each of Experiment Examples 3 to 10, the reinforcing member 16 was configured using carbon fiber as the reinforcing fiber, using epoxy resin as the matrix resin, using the first bias layer 16A with an orientation direction of the reinforcing fiber 30 intersecting with the axial X-direction of the shaft 12 at 45°, and using the second bias layer 16B with an orientation direction of the reinforcing fiber 30 intersecting with the axial X-direction of the shaft 12 at −45°. In each of Experiment Examples 3 to 10, the reinforcing member 16 was configured using the first bias layer 16A, the second bias layer 16B, and the straight layer 16C with the same configuration.

Experiment Example 1 corresponds to a comparative example, in which the reinforcing member 16 was not provided, so it did not satisfy claim 1 of the present technology.

Experiment Example 2 corresponded to a comparative example, with the difference ΔD set to 0.1 mm, which is on the lower limit of the range 0.1 mm≤ΔD≤0.5 mm, but the upper end 1612 of the reinforcing member 16 was at the same position as the upper end 2810 of the cylindrical portion 28 of the hosel portion 24, so it did not satisfy claim 1 of the present technology.

Experiment Example 3 satisfied claims 1, 2, and 4 of the present technology.

In Experiment Example 3, the difference ΔD was set to 0.1 mm, which is on the lower limit of the range 0.1 mm≤ΔD≤0.5 mm.

Also, in Experiment Example 3, the lower end 1610 of the reinforcing member 16 was located at a position 3 mm below the upper end 2810 of the cylindrical portion 28, which was below the range from 5 mm to 30 mm, so it did not satisfy claim 3 of the present technology.

Also, the upper end 1612 of the reinforcing member 16 was located at a position 27 mm above the upper end 2810 of the cylindrical portion 28, which was close to the upper limit value of the range from 5 mm to 30 mm.

Therefore, with an index value of 105 for impact load and 103 for durability and a total score of 208, the evaluation was higher compared with Experiment Examples 1 and 2, but the evaluation was lower compared with Experiment Examples 4 to 8 that satisfied all of claims 1 to 4 of the present technology.

Experiment Example 4 satisfied all of claims 1 to 4 of the present technology.

In Experiment Example 4, the difference ΔD was set to 0.1 mm, which is on the lower limit of the range 0.1 mm≤ΔD≤0.5 mm.

Also, in Experiment Example 4, the lower end 1610 of the reinforcing member 16 was located at a position 5 mm below the upper end 2810 of the cylindrical portion 28, which was within the range from 5 mm to 30 mm.

Also, the upper end 1612 of the reinforcing member 16 was located at a position 25 mm above the upper end 2810 of the cylindrical portion 28, which was within the range from 5 mm to 30 mm.

Therefore, with an index value of 115 for impact load and 110 for durability and a total score of 225, the evaluation was higher compared with Experiment Examples 1 and 2.

Experiment Example 5 satisfied all of claims 1 to 4 of the present technology.

In Experiment Example 5, the difference ΔD was set to 0.1 mm, which is on the lower limit of the range 0.1 mm≤ΔD≤0.5 mm.

Also, in Experiment Example 5, the lower end 1610 of the reinforcing member 16 was located at a position 10 mm below the upper end 2810 of the cylindrical portion 28, which was within the range from 5 mm to 30 mm.

Also, the upper end 1612 of the reinforcing member 16 was located at a position 20 mm above the upper end 2810 of the cylindrical portion 28, which was within the range from 5 mm to 30 mm.

Therefore, with an index value of 133 for impact load and 127 for durability and a total score of 260, the evaluation was higher compared with Experiment Examples 1 and 2.

Experiment Example 6 satisfied all of claims 1 to 4 of the present technology.

In Experiment Example 6, the difference ΔD was set to 0.1 mm, which is on the lower limit of the range 0.1 mm≤ΔD≤0.5 mm.

Also, in Experiment Example 6, the lower end 1610 of the reinforcing member 16 was located at a position 15 mm below the upper end 2810 of the cylindrical portion 28, which was within the range from 5 mm to 30 mm.

Also, the upper end 1612 of the reinforcing member 16 was located at a position 15 mm above the upper end 2810 of the cylindrical portion 28, which was within the range from 5 mm to 30 mm.

Therefore, with an index value of 135 for impact load and 125 for durability and a total score of 260, the evaluation was higher compared with Experiment Examples 1 and 2.

Experiment Example 7 satisfied all of claims 1 to 4 of the present technology.

In Experiment Example 7, the difference ΔD was set to 0.3 mm, which within the range 0.1 mm≤ΔD≤0.5 mm.

Also, in Experiment Example 7, the lower end 1610 of the reinforcing member 16 was located at a position 15 mm below the upper end 2810 of the cylindrical portion 28, which was within the range from 5 mm to 30 mm.

Also, the upper end 1612 of the reinforcing member 16 was located at a position 15 mm above the upper end 2810 of the cylindrical portion 28, which was within the range from 5 mm to 30 mm.

Therefore, with an index value of 121 for impact load and 122 for durability and a total score of 243, the evaluation was higher compared with Experiment Examples 1 and 2, but the evaluation was lower compared with Experiment Example 6. This is because the difference ΔD was larger than that for Experiment Example 6.

Experiment Example 8 satisfied all of claims 1 to 4 of the present technology.

In Experiment Example 8, the difference ΔD was set to 0.5 mm, which is on the upper limit of the range 0.1 mm≤ΔD≤0.5 mm.

Also, in Experiment Example 8, the lower end 1610 of the reinforcing member 16 was located at a position 15 mm below the upper end 2810 of the cylindrical portion 28, which was within the range from 5 mm to 30 mm.

Also, the upper end 1612 of the reinforcing member 16 was located at a position 15 mm above the upper end 2810 of the cylindrical portion 28, which was within the range from 5 mm to 30 mm.

Therefore, with an index value of 117 for impact load and 113 for durability and a total score of 230, the evaluation was higher compared with Experiment Examples 1 and 2, but the evaluation was lower compared with Experiment Examples 6 and 7. This is because the difference ΔD was larger than that for Experiment Examples 6 and 7.

Experiment Example 9 satisfied claims 1, 3, and 4 of the present technology.

In Experiment Example 9, the difference ΔD was set to 0.7 mm, which is above the upper limit of the range 0.1 mm≤ΔD≤0.5 mm, so claim 2 was not satisfied.

Also, in Experiment Example 9, the lower end 1610 of the reinforcing member 16 was located at a position 15 mm below the upper end 2810 of the cylindrical portion 28, which was within the range from 5 mm to 30 mm.

Also, the upper end 1612 of the reinforcing member 16 was located at a position 15 mm above the upper end 2810 of the cylindrical portion 28, which was within the range from 5 mm to 30 mm.

Therefore, with an index value of 107 for impact load and 105 for durability and a total score of 212, the evaluation was lower compared with Experiment Example 8. This is because the difference ΔD was outside of the range.

Experiment Example 10 satisfied claims 1, 2, and 4 of the present technology.

In Experiment Example 10, the difference ΔD was set to 0.1 mm, which is on the lower limit of the range 0.1 mm≤ΔD≤0.5 mm.

Also, in Experiment Example 10, the lower end 1610 of the reinforcing member 16 was located at a position 27 mm below the upper end 2810 of the cylindrical portion 28, which was near the upper limit value of the range from 5 mm to 30 mm.

Also, the upper end 1612 of the reinforcing member 16 was located at a position 3 mm above the upper end 2810 of the cylindrical portion 28, which was below the range from 5 mm to 30 mm, so it did not satisfy claim 3 of the present technology.

Therefore, with an index value of 104 for impact load and 103 for durability and a total score of 207, the evaluation was higher compared with Experiment Examples 1 and 2, but the evaluation was lower compared with Experiment Examples 4 to 8 that satisfied all of claims 1 to 4 of the present technology.

In the following, each of the evaluation items is examined.

(1) Impact Load

Experiment Examples 4 to 8 that satisfied all of claims 1 to 4 of the present technology had impact loads in the range from 115 to 135, Experiment Examples 3, 9, and 10 that satisfied claims 1 and 4 but did not satisfy either claim 2 or claim 3 had impact loads in the range from 104 to 107, so Experiment Examples 3 to 10 that are within the range of the present technology were superior in terms of impact load and achieved a better result compared with Experiment Examples 1 and 2 which were outside the range of the present technology.

(2) Durability Experiment Examples 4 to 8 that satisfied all of claims 1 to 4 of the present technology had durability in the range from 110 to 127, Experiment Examples 3, 9, and 10 that satisfied claims 1 and 4 but did not satisfy either claim 2 or claim 3 had durability in the range from 103 to 105, so Experiment Examples 3 to 10 that are within the range of the present technology were superior in terms of durability and achieved a better result compared with Experiment Examples 1 and 2, which were outside the range of the present technology.

(3) Total Points

Experiment Examples 4 to 8 that satisfied all of claims 1 to 4 of the present technology had total points in the range from 225 to 260, Experiment Examples 3, 9, and 10 that satisfied claims 1 and 4 but did not satisfy either claim 2 or claim 3 had total points in the range from 207 to 212, so Experiment Examples 3 to 10 that are within the range of the present technology were superior in terms of total points and achieved a better result compared with Experiment Examples 1 and 2, which were outside the range of the present technology.

The invention claimed is:

1. A golf club, comprising:

a hollow shaft; and a golf club head having a hosel portion into which a tip side end portion of the shaft is inserted and fixed;

the hosel portion including a cylindrical portion that extends to an inside and an outside of the golf club head and in which a shaft installation hole is provided for inserting the tip side end portion, a reinforcing member being installed on an inner circumferential surface of the shaft extending in an axial direction of the shaft to straddle an upper end of the cylindrical portion, the reinforcing member having a cylindrical shape configured by laminating prepegs in which reinforcing fiber is impregnated with matrix resin, and the reinforcing member being configured from a first bias layer in which an orientation direction of the reinforcing fiber intersects with the axial direction of the shaft, a second bias layer in which an orientation direction of the reinforcing fiber intersects with the axial direction of the shaft and intersects with the orientation direction of the reinforcing fiber of the first bias layer, and a straight layer in which the orientation direction of the reinforcing fiber is parallel to the axial direction of the shaft; wherein a lower end of the reinforcing member is positioned within a range from 5 mm to 30 mm below the upper end of the cylindrical portion, and an upper end of the reinforcing member is positioned within a range from 5 mm to 30 mm above the upper end of the cylindrical portion.

2. The golf club according to claim 1, wherein an outer diameter of the reinforcing member is smaller than an inner diameter of the tip side end portion in a range from 0.1 mm to 0.5 mm.

3. The golf club according to claim 2, wherein the shaft is made of steel.

4. The golf club according to claim 1, wherein the shaft is made of steel.

5. The golf club according to claim 1, wherein the orientation direction of the reinforcing fiber from which the first bias layer is configured and the orientation direction of the reinforcing fiber from which the second bias layer is configured have line symmetry with respect to the axial direction of the shaft.

6. The golf club according to claim 1, wherein the orientation direction of the reinforcing fiber from which the first bias layer is configured is +45° with respect to the axial direction of the shaft, and the orientation direction of the reinforcing fiber from which the second bias layer is configured is −45° with respect to the axial direction of the shaft.

7. The golf club according to claim 1, wherein:

the lower end of the reinforcing member is positioned within a range from 5 mm to 27 mm below the upper end of the cylindrical portion, and the upper end of the reinforcing member is positioned within a range from 5 mm to 27 mm above the upper end of the cylindrical portion.

8. The golf club according to claim 1, wherein:

the lower end of the reinforcing member is positioned within a range from 5 mm to 25 mm below the upper end of the cylindrical portion, and the upper end of the reinforcing member is positioned within a range from 5 mm to 25 mm above the upper end of the cylindrical portion.

9. The golf club according to claim 1, wherein:

the lower end of the reinforcing member is positioned within a range from 5 mm to 20 mm below the upper end of the cylindrical portion, and the upper end of the reinforcing member is positioned within a range from 5 mm to 20 mm above the upper end of the cylindrical portion.

* * * * *